United States Patent [19]

Ferris

[11] 4,337,949

[45] Jul. 6, 1982

[54] PLAYING PIECE PROPELLING GAME DEVICE

[75] Inventor: Michael J. Ferris, Chicago, Ill.

[73] Assignee: Marvin Glass & Associates, Chicago, Ill.

[21] Appl. No.: 226,910

[22] Filed: Jan. 21, 1981

[51] Int. Cl.[3] ..... A63B 65/12; A63B 67/06

[52] U.S. Cl. ..... 273/324; 273/325; 273/399; 273/355

[58] Field of Search ..... 273/324, 325, 326, 327, 273/328, 398, 399, 400, 401, 145 CA, 355

[56] References Cited

U.S. PATENT DOCUMENTS

| | | | |
|---|---|---|---|
| 1,091,739 | 3/1914 | Falker | 273/324 |
| 2,287,113 | 6/1942 | Markey | 273/401 |
| 3,356,369 | 12/1969 | Stubbmann | 273/145 CA |
| 3,764,142 | 10/1973 | Stubbmann | 273/399 |
| 4,253,669 | 3/1981 | Ferris et al. | 273/399 X |

*Primary Examiner*—George J. Marlo

*Attorney, Agent, or Firm*—Mason, Kolehmainen, Rathburn & Wyss

[57] ABSTRACT

A playing piece propelling game device includes a generally dish-shaped open-topped playing surface divided into a plurality of compartments which are defined on the surface by a plurality of radially arranged upstanding walls on the surface. The surface further includes a generally horizontal peripheral flange. An upstanding receptacle is defined centrally on the playing surface for receiving one or more playing pieces in the form of discs. A manually actuable propelling apparatus is aligned with the receptacle and attached to the playing surface for propelling the playing pieces from the receptacle onto the playing surface. The propelling apparatus includes a U-shaped leaf spring with a pair of spaced apart downwardly directed arms upon which the playing surface is supported. The propelling means is arranged to propel the playing pieces upwardly in response to a downward actuation applied to the flange in a direction of flight determined by the manner and angle of application of the force to the flange.

2 Claims, 4 Drawing Figures

PLAYING PIECE PROPELLING GAME DEVICE

BACKGROUND OF THE INVENTION

1. Field of the Invention

This invention relates generally to playing piece propelling game devices and more particularly to a game device with a player manipulatable target.

2. Description of the Prior Art

Game devices involving the propulsion of projectiles into a target receptacle are well known. In the age-old game of tiddledywinks, the object is to snap a small disc called a wink or tiddledywink from a flat surface into a small container. While such games have taken a variety of forms, there is a continuing interest in new and different game devices of this sort.

SUMMARY OF THE INVENTION

Many objects and advantages resulting in considerable entertainment value are achieved by a playing piece propelling game device. The game device includes a plurality of playing pieces and a playing surface having a plurality of distinct compartments. A receptacle in the playing surface is capable of receiving one of the playing pieces. A manually actuable propelling means is aligned with the receptacle and attached to the playing surface for propelling one of the playing pieces from the receptacle onto the playing surface.

DESCRIPTION OF THE PREFERRED EMBODIMENT

Figure 1:
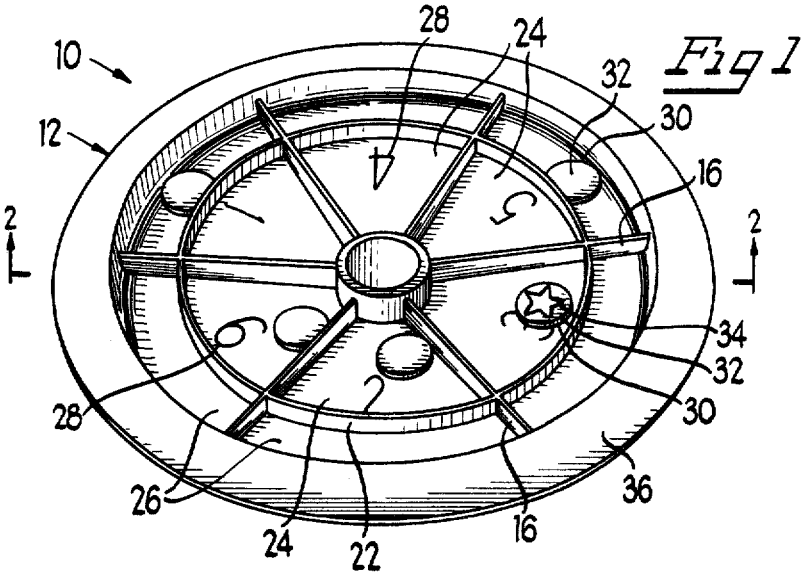
FIG. 1 is a perspective view of one embodiment of the present invention.
Figure 2:
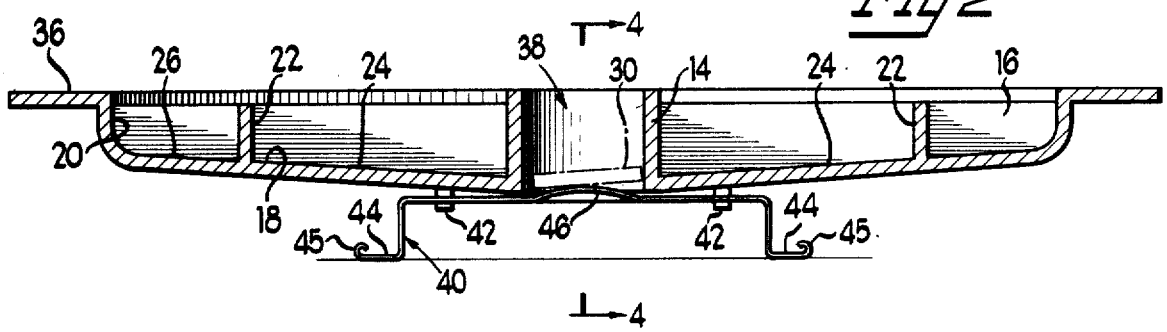
FIG. 2 is an enlarged, cross-sectional view taken generally along the line 2—2 in FIG. 1.

Referring to the drawing wherein like reference characters are used for like parts throughout, there is illustrated in FIG. 1 a playing piece propelling game device 10 including a circular, plate-shaped housing 12 conveniently made of integrally molded plastic. The housing 12 includes a central raised cylindrical portion 14 and a plurality of angularly spaced splines 16 which extend radially from the cylindrical portion 14 across a toroidal depression 18. As shown in FIG. 2 the toroidal depression 18 slopes downwardly from its circular, peripheral wall 20 to the cylindrical portion 14. An intermediate wall 22 is positioned between the cylindrical portion 14 and the peripheral wall 20, arranged concentrically with the peripheral wall 20.

Thus a plurality of pie-shaped compartments 24 are arranged around the cylindrical portion 14 defined by adjacent splines 16 and intermediate wall 22. In addition, a plurality of peripheral compartments 26 are defined in the region between adjacent splines 16, peripheral wall 20, and intermediate wall 22. The pie-shaped compartments 24 bear numerical indicia 28 serving to distinguish each compartment 24 from the others. Each compartment 24 or 26 is sized to receive one or more disc-shaped playing pieces 30.

Each playing piece 30, conveniently formed of lightweight molded plastic, includes two faces 32. One face 32 bears distinguishing indicia 34, conveniently a star as shown in FIG. 1.

Extending radially outwardly from the upper edge of peripheral wall 20 is a flange 36. The flange 36 provides a grasping portion to allow a player to manually manipulate the housing 12.

Figure 4:
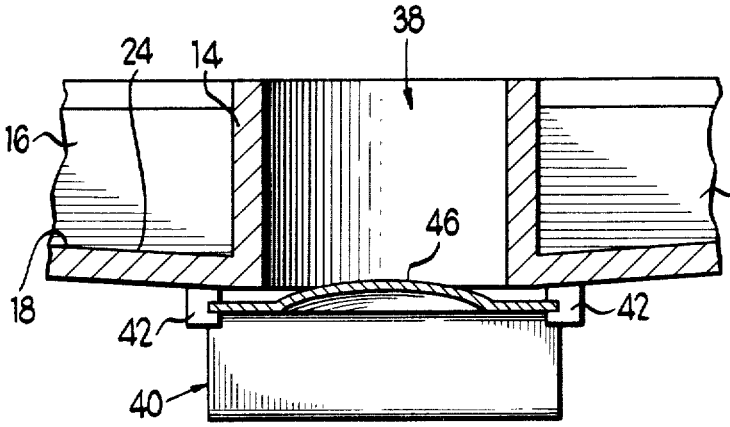
FIG. 4 is an enlarged, cross-sectional view taken generally along the line 4—4 in FIG. 2.

As shown in FIG. 2, an aperture 38 defined by cylindrical portion 14 extends completely through the housing 12. A U-shaped propelling mechanism 40 is aligned beneath and serves to close off the bottom of the aperture 38. The propelling mechanism 40 is preferably a leaf spring, conveniently in the form of a strip of spring steel or other resilient material with an elastic memory, formed into a downwardly facing U-shape and attached to the housing 12 by two brackets 42 to either side of the aperture 38. The propelling mechanism 40 includes a pair of spaced supporting feet 44, conveniently formed by bending the ends of the member 40 outwardly, and a central bubble-shaped extension 46 extending into the aperture 38, as shown in FIG. 4. The ends 45 of the feet 44 are rolled to protect the user from being cut by the edges of the mechanism 40.

Figure 3:
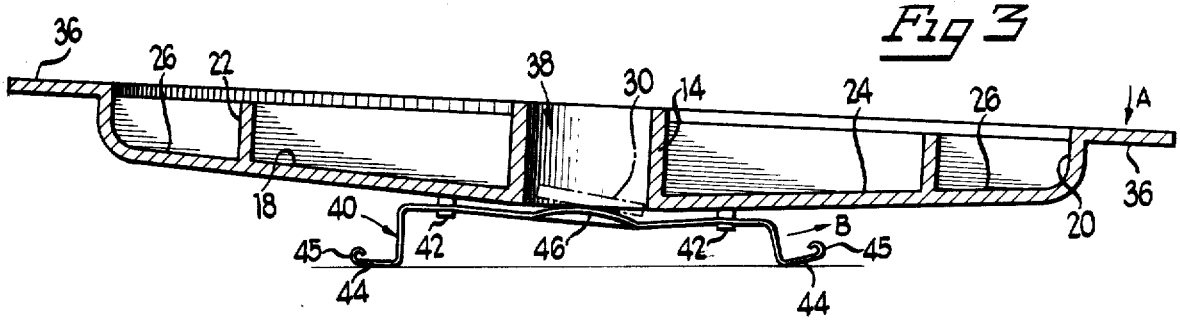
FIG. 3 is an enlarged, cross-sectional view also taken generally along the line 2—2 in FIG. 1 but showing the device in its actuated position.

When the housing 12 is manually depressed toward the supporting surface as indicated by the arrow A in FIG. 3, the propelling member 40 is deformed intermediately between supporting feet 44 causing a foot 44 to be deflected outwardly, as indicated by the arrow B in FIG. 3. When the housing 12 is released the propelling member 40 springs back to its original position. As a result, a playing piece 30, positioned atop the bubble-shaped extension 46 of member 40, is propelled over the housing 12 landing in one of the compartments 24 or 26. The housing 12 may be depressed by manually pressing downwardly on the flange 36 at two diametrically opposed points and releasing the housing, causing the playing piece 30 to be propelled through cylindrical portion 14. Alternatively, the flange 36 can be depressed at only one point as indicated by the arrow A in FIG. 3 and released, with essentially the same results.

Preferably the playing piece 30 is propelled well above the housing 12. A player may then, grasping the flange 36, slide the housing 12 on feet 44 along the supporting surface in an attempt to position a desired pie-shaped compartment 24 in a position to receive a descending playing piece 30. Conveniently a player receives a different number of points depending on the compartment 24 in which the playing piece 30 lands. However, in one convenient game scheme if a playing piece 30 lands in one of the peripheral compartments 26 no points are scored. On the other hand, if the playing piece 30 does not land on the housing 12, the player may replay the playing piece 30 according to the same convenient game scheme.

The distinguishing indicia 34 are useful in implementing a variety of game possibilities. For example, if a playing piece lands with the indicia 34 facing upwardly, extra points may be awarded. Similarly, if a playing piece lands with the face 32 not bearing indicia 34 pointing upwardly, that piece may be removed from the housing 12, resulting in loss of the points scored, when another playing piece 30 played by another player lands in the same compartment 24. However, if the playing piece lands with the indicia 34 pointing upwardly, that playing piece 30 cannot be removed from the housing 12. Similarly a playing piece 30 already positioned in a compartment 24 may be flipped over by a subsequently landing playing piece 30 changing its status.

Conveniently, each player has a set of distinctly colored playing pieces 30. A player may then position as many playing pieces as possible within the same compartment 24 without penalty. However, if another player positions one of his or her playing pieces 30 in a compartment 24 occupied by another player's playing piece 30, the previously positioned playing piece, not positioned with the star indicia 34 facing upwardly, is removed and the previously scored points for that piece forfeited. Conveniently the winner is the player with the highest cumulative score after five actuations of the housing 12.

Many modifications and variations of the present invention are possible in light of the above teaching. Thus, it is to be understood, that within the scope of the appended claims, the invention may be practiced otherwise than as specifically described above.

What is claimed and desired to be secured by Letters Patent of the United States is:

1. A playing piece propelling game device comprising:

a plurality of disc-shaped playing pieces;

a generally circular, dish-shaped, open, playing surface having a plurality of distinct compartments defined on said surface by a plurality of radially arranged upstanding walls on the surface, said surface further including a generally horizontal peripheral flange;

an upstanding receptacle on said playing surface for receiving one of said playing pieces; and a manually actuable propelling means aligned with said receptacle and attached to said playing surface for propelling one of said playing pieces from said receptacle onto said playing surface, said propelling means including a U-shaped leaf spring with a pair of spaced apart downwardly directed arms upon which said playing surface is supported, said propelling means arranged to propel one of said playing pieces upwardly in response to a downward actuation applied to said flange, the direction or propulsion of said playing piece determined by the manner of application of said force to said flange.

2. The game device of claim 1 wherein each of said playing pieces includes means for distinguishing one side of said playing piece from another.

* * * * *